United States Patent [19]

Meyer et al.

[11] 4,391,884

[45] Jul. 5, 1983

[54] PROCESS FOR THE PRODUCTION OF A PHOTOGRAPHIC COLOR IMAGE BY THE SILVER DYE BLEACH PROCESS AND SUITABLE COLOR PHOTOGRAPHIC MATERIAL THEREFOR

[75] Inventors: Armin Meyer, Belfaux; Carlo Boragine, Villars-sur-Glâne, both of Switzerland

[73] Assignee: Ciba-Geigy AG, Basel, Switzerland

[21] Appl. No.: 255,069

[22] Filed: Apr. 17, 1981

[30] Foreign Application Priority Data

Apr. 30, 1980 [CH] Switzerland ..... 3344/80

[51] Int. Cl.[3] ..... G03C 7/00

[52] U.S. Cl. ..... 430/17; 430/390; 430/391; 430/392; 430/505; 430/510; 430/559

[58] Field of Search ..... 430/390, 391, 392, 559, 430/561, 562, 563, 502, 504, 505, 17, 510

[56] References Cited

U.S. PATENT DOCUMENTS

| | | | |
|---|---|---|---|
| 2,278,984 | 4/1942 | Gaspar et al. | 430/390 |
| 3,498,787 | 3/1970 | Wilson et al. | 430/391 |
| 3,650,739 | 3/1972 | Marthaler et al. | 430/391 |
| 3,743,506 | 7/1973 | Boragine et al. | 430/391 |
| 3,787,215 | 1/1974 | Piller | 430/563 |

FOREIGN PATENT DOCUMENTS 421727 12/1934 United Kingdom .

*Primary Examiner*—J. Travis Brown
*Attorney, Agent, or Firm*—Joseph G. Kolodny

[57] ABSTRACT

A process for the production of a photographic color image by the silver dye bleach process, using a photographic material which comprises, on a base, at least one light-sensitive silver halide emulsion layer, which can contain a diffusion-resistant bleachable image dye, and immediately above this layer, on the side facing the light source, a silver halide-free layer containing a diffusion-resistant, bleachable image dye.

The process gives very sharp photographic color images.

14 Claims, 3 Drawing Figures

Figure 1:
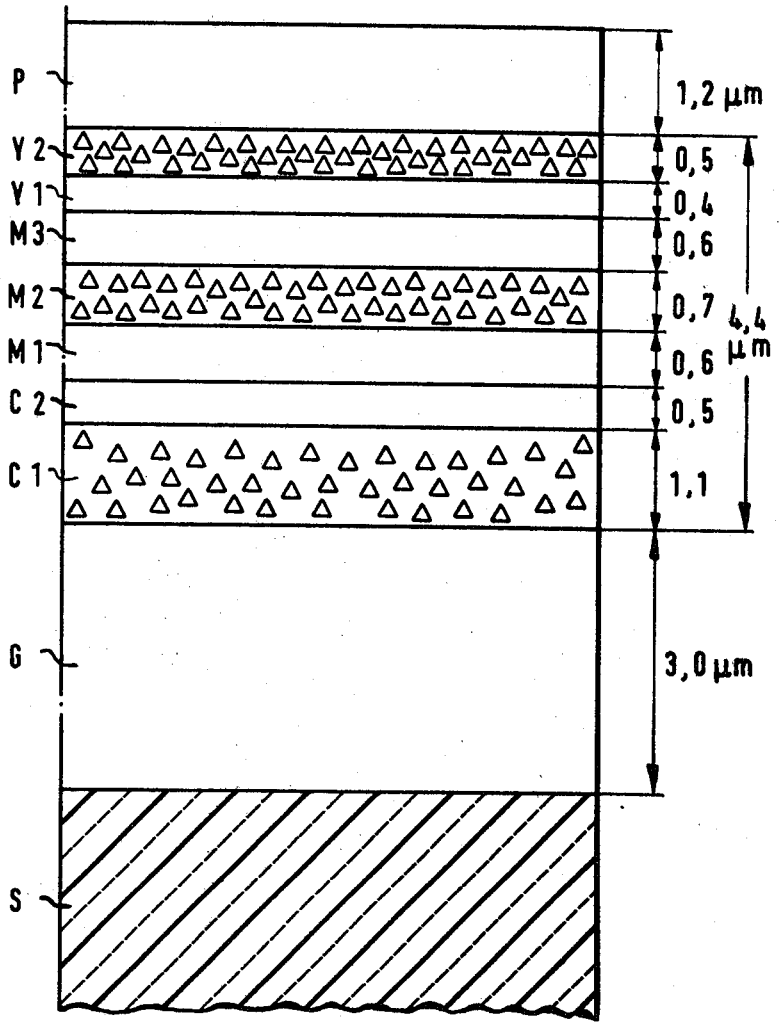

PROCESS FOR THE PRODUCTION OF A PHOTOGRAPHIC COLOR IMAGE BY THE SILVER DYE BLEACH PROCESS AND SUITABLE COLOR PHOTOGRAPHIC MATERIAL THEREFOR

The present invention relates to a novel process for the production of a photographic colour image by the silver dye bleach process, to the use of the process for the production of colour images and to a suitable colour-photographic recording material.

A conventional material for the silver dye bleach process contains one or more emulsion layers coloured with a dye which can be bleached imagewise. Material of this type is exposed, developed and finally processed to give a colour image by bleaching the dye to an extent depending on the developed metallic silver, and removing the excess silver halide and metallic silver from the material. Particular importance attaches to multi-layer materials for colour images in natural colours, which materials comprise, on a transparent or reflecting base, a red-sensitive silver halide emulsion layer dyed with a cyan dye, over this a green-sensitive silver halide emulsion layer dyed with a magenta dye, and, uppermost, a blue-sensitive silver halide emulsion layer dyed with a yellow dye. In addition, filter layers and other intermediate layers can be present between these emulsion layers.

In the conventional build-up of a silver dye bleach material, the image dye and the silver halide emulsion corresponding to this dye are always in the same layer. However, it has at various times proved advantageous to deviate from this principle and to accommodate at least a part of the light-sensitive silver halide emulsion in a layer adjacent to the layer containing the image dye.

For example, Swiss Pat. No. 383,335 proposes to influence the gradation curve of a silver dye bleach material, especially in the shoulder portion of the curve, by arranging an emulsion layer containing the image dye, and an emulsion layer free from the image dye, above one another in such a way that the dye-free layer is above the dye-containing layer on the side facing the light source. The converse arrangement, in which the emulsion layer containing the image dye is arranged above a dye-free emulsion layer on the side facing the incident light is described in Swiss Pat. No. 456,434. With this arrangement it proves possible to influence favourably the gradation, especially in the base portion of the curve. Finally, Swiss Pat. No. 465,804 describes an arrangement in which a silver halide emulsion layer containing an image dye is arranged between two dye-free light-sensitive emulsion layers. As a result of this measure, exceptionally great freedom in influencing the gradation curve of the silver dye bleach material is achieved.

U.S. Pat. No. 2,391,198 proposes to arrange, between two silver halide emulsion layers containing an image dye, a third, dye-free emulsion layer, which layer serves to bleach, during the subsequent dye bleaching, dyes which have migrated into it by diffusion from the adjacent layers, so as, on the one hand, to prevent undesired colour coupling between the dyed emulsion layers and, on the other hand, also to prevent the formation of a residual colour fog.

U.S. Pat. No. 2,183,394 and British Pat. No. 483,464 describe arrangements in which dyed and undyed silver halide emulsion layers are used adjoining one another, the undyed emulsion layers being dyed, after the silver development, with further dyes in order to achieve specific colour effects.

A feature of the layer build-up to be found in all the abovementioned patents is the use of image-active layers, which comprise either a light-sensitive silver halide emulsion layer alone or a silver halide emulsion layer with image dyes. In contrast, British Pat. No. 421,727 describes a silver dye bleach material which comprises a light-sensitive silver halide emulsion, without dye, in one layer and below it, on the side facing away from the incident light, a silver halide-free light-insensitive dye layer. The "remote bleaching" which occurs in the adjacent layer during the dye bleach process results from the fact that the dye bleach catalysts employed, for example diazine compounds, are reduced, on the image silver, to the dihydro compound and can, in this state, migrate the short distance to the adjacent dye layer. The processes described in Swiss Pat. Nos. 383,335, 456,434 and 465,804, referred to earlier, are also based on the same principle.

However, the photographic materials described above still show certain disadvantages, requiring improvement, in respect of image sharpness and resolving power.

It is therefore the object of the present invention to provide a process for the preparation of a photographic colour image by the silver dye bleach process, which overcomes these disadvantages and provides photographic coloured images which, for example, are very sharp.

It has now been found that a silver dye bleach material in which at least one silver halide emulsion layer containing an image dye is divided into two components in such a way that a silver halide-free image dye layer is located, on the side facing the incident light, immediately above a corresponding silver halide emulsion layer which can contain additional image dye, exhibits surprising advantages over conventional materials and also over materials in which, though the image dye and the emulsion are partially separated, all the layers, or at least the layers facing the incident light, contain a silver halide emulsion.

In fact, the silver halide-free dye layer located above the emulsion layer largely absorbs the scattered light originating from layers nearer the top within the layer assembly, and does so the more intensely, the more the scattered light deviates from the vertical direction of incidence and accordingly has to pass through a greater thickness of layer. This effect results in a great gain in sharpness of image. This gain in sharpness and accordingly in resolving power cannot be achieved with the arrangement according to the above-mentioned British Pat. No. 421,727, because, in the sequence of layers described there, the light-sensitive emulsion layer is located above the dye layer and is therefore directly impinged on by the scattered light. In principle, all of the image dye used in a pair of layers can be incorporated into the upper, silver halide-free layer. Since, however, such an arrangement has an adverse influence on the gradation of the photographic material, it will in general be preferred to accommodate a part of the image dye in the emulsion-containing layer.

Accordingly, the present invention relates to a process for the production of a photographic colour image by the silver dye bleach process, by exposure, silver developing, dye bleaching, silver bleaching and fixing, and using a photographic material which contains light-sensitive silver halide layers and dye layers on a base, which process comprises exposing image-wise a photographic material, which has at least one light-sensitive silver halide emulsion layer, which can contain a diffusion-resistant, bleachable image dye, and immediately above it, on the side facing the light source, a silver halide-free layer containing a diffusion-resistant bleachable image dye and processing the material, in the presence of a dye bleach catalyst, to give a colour image, the colour image being produced exclusively by image dyes present in the photographic material prior to exposure.

The invention further relates to the colour-photographic material suitable for the process according to the invention, and to the use of this process for the production of colour images.

The diffusion-resistant bleachable cyan, magenta or yellow dye which may be contained in the light-sensitive silver halide emulsion layer, and the dye contained in the silver halide-free layer, are the same dye.

The photographic material can contain only one such pair of layers or several such pairs of layers; for example, in a trichromatic material it can contain one pair of layers for each of the two primary colours cyan and magenta. With respect to the topmost layer which contains the yellow dyestuff, the inventive arrangement is without effect since in this layer no light scattering can occur. In addition to the layers containing the silver halide emulsion and/or the image dye, other layers may also be present in the photographic material, for example protective layers, separating layers or filter layers, and individual layers of this type, if they are adjacent to a silver halide emulsion layer, can also contain image dyes.

The image dyes used can be the conventional bleachable azo dyes, in particular water-soluble, diffusion-resistant azo dyes, as listed, for example, in Swiss Pat. No. 572,230. Oil-soluble dyes and pigments can also be used, provided they are bleached sufficiently rapidly and completely by the conventional dye bleach baths.

An advantageous arrangement is shown, for example, in FIG. 1, in which the following are arranged successively, one above the other, on a base (S): a gelatine subbing layer (G), a red-sensitive emulsion layer containing a cyan dye (C1), an emulsion-free layer containing a cyan dye (C2), a silver halide-free layer containing a magenta dye (M1), a green-sensitised emulsion layer containing a magenta dye (M2), a layer containing a magenta dye (M3), a silver halide-free layer containing a yellow image dye (Y1), a blue-sensitive emulsion layer containing a yellow image dye (Y2) and a protective layer consisting of gelatin. The layers C1/C2 and M2/M3 form layer pairs in accordance with the present invention. The additional layer M1, containing magenta dye, serves on the one hand as an image dye layer and on the other hand also as an additional separating layer between the two layers C2 and M2.

Figure 2:
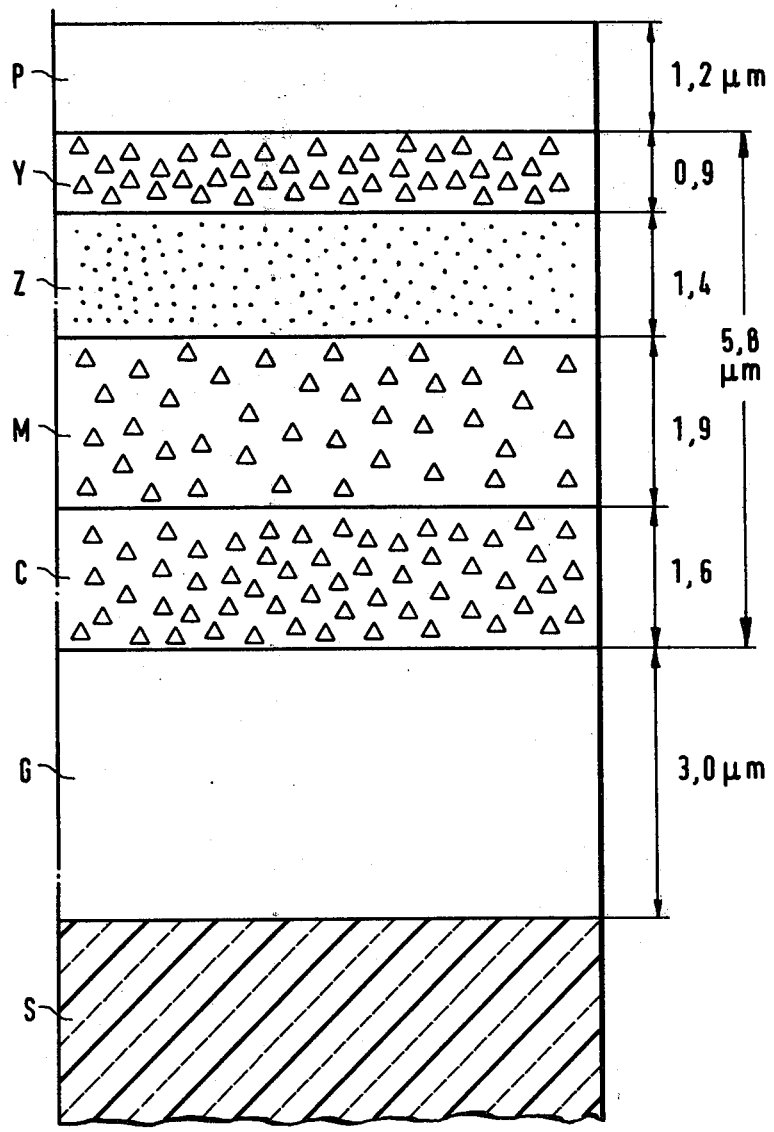
Figure 3:
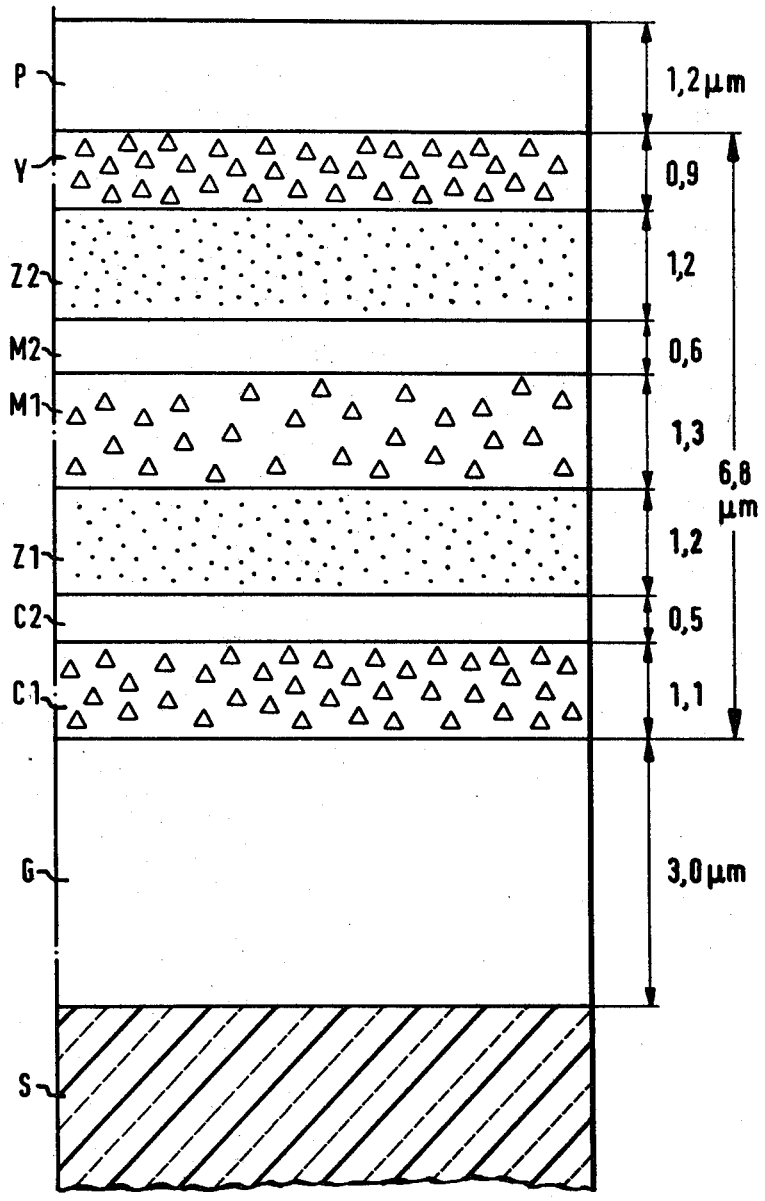

The numerical data in FIG. 1, and in the subsequent FIGS. 2 and 3, each represent the dry layer thickness in μm.

The bases used for the photographic layers are the conventional opaque or transparent materials, such as glass, cellulose triacetate, polyester, coated paper or synthetic papers made from polystyrene or nylon fibres.

Silver halide-free layers containing image dye can also serve as protective layers in that they protect emulsion layers, below them, against scratching and other mechanical stress. In particular, they can also serve this purpose during the coating process, where, for example, when they are applied as the uppermost layer of a multilayer assembly, they protect the pressure-sensitive emulsion layer below them, during drying, against direct contact with rollers and against formation of abrasion-fog.

The light-sensitive silver halide emulsions used are preferably silver halide emulsions or mixed emulsions, for example silver chloride/bromide, silver bromide/iodide or silver chloride/bromide/iodide emulsions. Since, in silver dye bleach materials, a part of the incident light is always absorbed by the image dyes present, it is in general advantageous to use very sensitive silver halide emulsions. This is particularly true if, as in the conventional materials for images in natural colours, the emulsions are sensitised in the spectral regions which correspond to the particular absorption maximum of the corresponding image dye. Optical desensitisation, ie. the loss of actinic light, is in that case particularly great. By using emulsions which are not sensitised in the main absorption region of the corresponding image dye, the process can also be used to produce (so-called) false colour images.

Because of their high sensitivity, silver halide emulsions of the cubic-monodisperse type, such as can be produced by conventional methods, for example by the double jet method, have proved particularly suitable. This is especially the case where the inherently steep gradation of the monodisperse emulsions does not interfere. In addition to their high sensitivity, the cubic-monodisperse emulsions also have the advantage of giving particularly sharp images in the process according to the invention. The already existing advantage of an increased resolving power can thereby be increased yet further and can, in particular, be utilised for the production of microfilms and the like.

In cases where a steep gradation is not desired, polydisperse emulsions can be incorporated into the material according to the invention. This leads to a flattening of the gradation, without however, detracting from the resolving power of the material according to the invention.

The photographic materials according to the invention are processed by the conventional methods, which comprise the usual process stages such as silver developing, dye bleaching, silver bleaching and fixing, with or without one or more washing stages, and in which the silver bleaching can be combined with dye bleaching and/or fixing in one and the same processing stage. Suitable processing methods are described, for example, in German Pat. Nos. 1,924,723, 2,258,076, 2,423,814, 2,448,433, 2,547,720 and 2,651,969.

Because of their increased resolving power, the photographic materials used according to the invention are particularly suitable for the production of microfilms. A microfilm with which positive coloured images can be produced directly in one operation, can be prepared as described in Example 1.

EXAMPLE 1

A photographic material according to the present invention is prepared from a cubic monodisperse silver chloride/bromide emulsion containing 20 mol% of silver chloride and having crystals of 0.20 μ edge length, and from the cyan image dye:

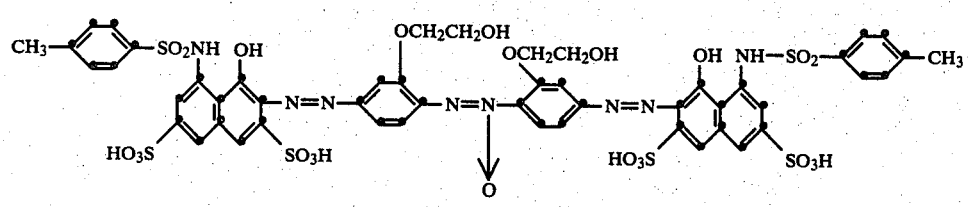

the magenta image dye:

-continued

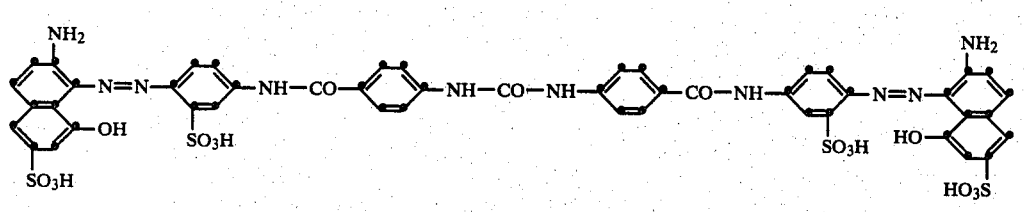

and the yellow image dye:

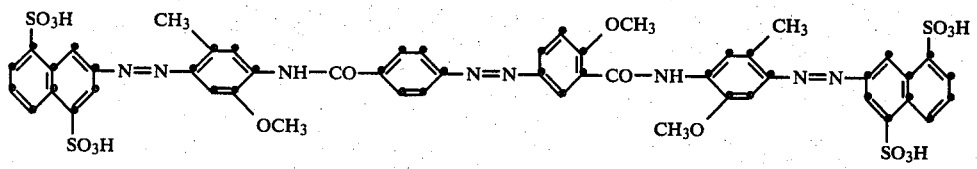

by applying the corresponding gelatin layers successively to a polyester base (S), and drying them.

In the table which follows, the amounts by weight of silver (Ag), gelatin (Gel) and dye (D) applied for each layer are shown in milligrams per square meter.

| | Ag mg/m² | Gel mg/m² | D mg/m² | |
|---|---|---|---|---|
| 1. Gelatin subbing layer | — | 3,000 | — | |
| 2. Cyan emulsion layer | 720 | 1,100 | 147 | 220 |
| 3. Cyan dye layer | — | 550 | 73 | |
| 4. Magenta dye layer | — | 630 | 123 | |
| 5. Magenta emulsion layer | 700 | 630 | 123 | 369 |
| 6 Magenta dye layer | — | 630 | 123 | |
| 7. Yellow dye layer | — | 450 | 109 | 218 |
| 8. Yellow emulsion layer | 470 | 450 | 109 | |
| 9. Protective layer | — | 1,200 | — | |
| | 1,890 | 8,140 | 807 | |

The silver halide emulsion used for the cyan emulsion layer (2) was sensitised beforehand for red light, whilst the silver halide emulsion used for the magenta emulsion layer was sensitised beforehand for green light.

The arrangement of the layers corresponds to FIG. 1.

For comparison, a second photographic material, having a conventional sequence of layers, is prepared using the same silver halide emulsions and image dyes, the amounts of silver and of dye in the individual layers being chosen so that after exposure and processing approximately the same optical density results:

| | Ag mg/m² | Gel mg/m² | D mg/m² |
|---|---|---|---|
| 1. Gelatin subbing layer | | 3,000 | — |
| 2. Cyan: emulsion and dye layer | 720 | 1,650 | 220 |
| 3. Magenta: emulsion and dye layer | 700 | 1,900 | 369 |
| 4. Gelatin intermediate layer | — | 1,400 | — |
| 5. Yellow: emulsion and dye layer | 470 | 900 | 218 |
| 6. Gelatin protective layer | — | 1,200 | — |
| | 1,890 | 10,050 | 807 |

This layer arrangement corresponds to FIG. 2. The numbers in FIGS. 1 and 2 show the dry layer thicknesses in μm.

The layer marked Z in FIG. 2 can additionally contain colloidal silver and/or a bleachable yellow azo dye. In that case, it acts as a yellow filter layer, which is intended to prevent the action of blue radiation on the green-sensitive and red-sensitive layers. During dye bleaching, the yellow filter layer is bleached completely. The incorporation of the yellow filter layer is only necessary if the uppermost yellow layer does not have a sufficient filter action.

It can be seen from comparison of FIGS. 1 and 2 that the resulting conventional material has a total layer thickness which is about 25% greater, because larger amounts of gelatin are used. This increased value is necessary in order to impart the desired sensitometric properties to the material. However, the increased layer thickness has an adverse effect on the image sharpness, as is shown by the results of the photographic evaluation.

One strip of each of the two materials is exposed and subsequently processed as follows, at a temperature of 24° C.:

| 1. Silver developing bath | 4 minutes | |
|---|---|---|
| Hydroquinone | 6 | g/liter |
| 1-Phenyl-3-methyl-pyrazolidinone | 0.5 | " |
| Ethylene glycol monoethyl ether | 82 | " |
| Benzotriazole | 0.5 | " |
| Sodium ethylenediaminetetraacetate | 4 | " |
| Anhydrous potassium carbonate | 36 | " |

-continued

| | | |
|---|---|---|
| Sodium sulfite | 11 | " |
| Potassium metabisulfite | 18 | " |
| Potassium bromide | 2 | " |
| 2. Washing | 30 seconds | |
| 3. Bleaching bath | 4 minutes | |
| Disodium 4-nitrophenol-2-sulfonate | 2 | g/liter |
| 96% sulfuric acid | 38 | " |
| Ethylene glycol monoethyl ether | 80 | " |
| 2,3,6-Trimethylquinoxaline | 2 | " |
| Bis-(cyanoethyl)-sulfoethylphosphine | 5 | " |
| Anhydrous potassium carbonate | 0.5 | " |
| Potassium iodide | 15 | " |
| 4. Washing | 30 seconds | |
| 5. Fixing bath | 4 minutes | |
| Ammonium thiosulfate | 200 | g/liter |
| Ammonium disulfite | 22 | " |
| 25% ammonia | 8 | " |
| 6. Washing | 4 minutes | |

On comparing the exposed and processed step wedges, it is found that, as intended, both materials show virtually identical sensitometric values. However, a difference is found in respect of photographic acutance and resolving power.

The method of G. C. Higgins and R. N. Wolfe in J. of the SMPTE 65, 26 (Jan. 1965) and in J. of the Opt. Soc. of America 45, 121 (Febr. 1955) is used to measure the acutance.

To do so, a sharp edge is depicted on the material by the contact method. After processing, the change of density in the vicinity of the transition from the exposed to the unexposed part is measured with a microdensitometer. The acutance is the better, the steeper the transition from the exposed to the unexposed area. The steepness of this transition is calculated by a method described by the authors mentioned above, and denotes, in numerical terms, the increase in density per $\mu$m on a line of measurement running at rightangles to the exposed edge.

Measured in this way, the material according to the invention gives a value of $14.3\times10^{-3}$ whilst the comparative material, with a conventional layer arrangement, gives a value of only $10.6\times10^{-3}$. This improvement in the acutance is attributable to the lower layer thickness of the material according to the invention and to the reduction in light scattering brought about by the layer arrangement according to the invention.

EXAMPLE 2

The experiment described in Example 1 and the corresponding FIG. 1 is repeated, except that in place of the cubic-monodisperse emulsion a polydisperse silver bromide/iodide emulsion having a mean particle diameter of 0.20$\mu$ is used, the crystals containing 2.6 mol% of silver iodide. Further, in place of the cyan dye mentioned in Example 1, a dye of the formula

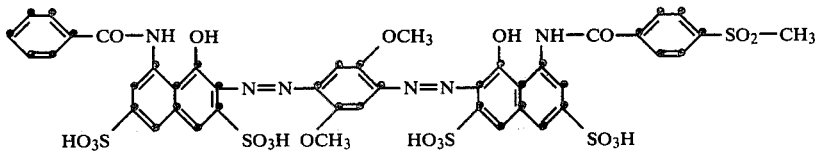

is used, the amounts of silver, dye and gelatin used in the cyan emulsion layer and the cyan dye layer being as follows:

| | Ag mg/m$^{mg-}$/m$^2$ | D mg/m$^2$ | | Gel mg/m$^2$ |
|---|---|---|---|---|
| Cyan emulsion layer Cl: | 550 | 184 | 368 | 800 |
| Cyan dye layer C2: | — | 184 | | 800 |

The images produced with this material also show a distinct improvement in acutance compared to images obtained with the conventional material according to FIG. 2.

EXAMPLE 3

Using the same components as in Example 1, a photographic material is prepared, which differs from that of Example 1 by the number and sequence of the layers employed:

The layers Y2 and Y1 of the material of Example 1, FIG. 1, are combined in a single layer Y; equally, the layers marked M1 and M3 in FIG. 1 are combined, as shown in FIG. 3, in a single emulsion-free dye layer M2 above the green-sensitised emulsion layer M1.

The layers M1 and Y1 of FIG. 1, which in Example 1 serve as separating layers, are missing and are replaced, as shown in FIG. 3, by gelatin intermediate layers, namely Z1 between the cyan pair of layers and the magenta pair of layers and Z2 between the yellow layer and the magenta set of layers.

The intermediate layer Z2 is additionally made into a bleachable yellow filter layer by incorporating 21 mg/m$^2$ of colloidal silver and 17 mg/m$^2$ of the yellow dye described in Example 1.

This arrangement of layers gives a distinct improvement in image sharpness.

What is claimed is:

1. A process for the production of a photographic colour image by the silver dye bleach process, by exposure, silver developing, dye bleaching, silver bleaching and fixing, and using a photographic material which contains light-sensitive silver halide layers and dye layers on a base, which process comprises exposing imagewise a photographic material, which has at least one light-sensitive silver halide emulsion layer, which can contain a diffusion-resistant, bleachable image dye, and immediately above it, on the side facing the light source, a silver halide-free layer containing a diffusion-resistant bleachable image dye, the light-sensitive silver halide emulsion layer and silver halide-free layer being free from a dye bleach catalyst and processing the material in a processing bath containing a dye bleach catalyst, to give a colour image, the colour image being produced exclusively by image dyes present in the photographic material prior to exposure.

2. A process according to claim 1, wherein the same image dye is used in the silver halide-containing layer and in the adjacent silver halide-free dye layer.

3. A process according to claim 2, wherein the image dye is a cyan dye, magenta dye or a yellow dye.

4. A process according to claim 3, wherein the photographic material contains 3 pairs each comprising a silver halide-containing dye layer and an adjacent silver halide-free dye layer, each of the pairs of layers containing one of the image dyes cyan, magenta or yellow.

5. A process according to claim 4, wherein the photographic material can contain additional protective layers, separating layers or filter layers.

6. A process according to claim 5, wherein the protective layers, separating layers and filter layers can contain a cyan dye, magenta dye or yellow dye.

7. A process according to claim 6, wherein the silver halide-free layers containing image dye can serve as protective layers.

8. A process according to claim 7, wherein the photographic material comprises coated on a support a gelatin subbing layer, a red-sensitive emulsion layer containing a cyan dye, an emulsion-free layer containing a cyan dye, a silver halide-free layer containing a magenta dye, a green sensitive emulsion layer containing a magenta dye, a layer containing a magenta dye, a silver halide-free layer containing a yellow dye, a blue-sensitive emulsion layer containing a yellow dye and a gelatine protective layer.

9. A process according to claim 1, wherein the light-sensitive silver halide emulsion is sensitised in such a way that is sensitivity maximum matches the absorption maximum of the corresponding image dye.

10. A process according to claim 1, wherein the light-sensitive silver halide emulsion is sensitised in such a way that its sensitivity maximum does not match the absorption maximum of the image dye.

11. A process according to claim 1, wherein a cubic-monodisperse silver halide emulsion is used in at least one light-sensitive layer.

12. A colour photographic material for the silver dye bleach process, suitable for use in the process according to claim 1, which has the composition stated in claim 1.

13. A colour photographic material for the silver dye bleach process according to claim 12, wherein the silver halide-free dye layer located above the silver halide emulsion layer of a layer pair absorbs scattered light.

14. The colour images produced by a process according to claim 1.

* * * * *

UNITED STATES PATENT AND TRADEMARK OFFICE

CERTIFICATE OF CORRECTION

PATENT NO. : 4,391,884

DATED : Jul. 5, 1983

INVENTOR(S) : Armin Meyer et al

It is certified that error appears in the above—identified patent and that said Letters Patent is hereby corrected as shown below:

Column 10, line 5, Delete "is" and insert --its--.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*